United States Patent [19]

Jacobson

[11] Patent Number: 4,612,741

[45] Date of Patent: Sep. 23, 1986

[54] RADIALLY SEGMENTED PLASTIC BUILDING

[76] Inventor: Clayton J. Jacobson, Box 5338, ELRB, Parker, Ariz. 85344

[21] Appl. No.: 435,470

[22] Filed: Oct. 20, 1982

[51] Int. Cl.[4] ..... E04H 1/00

[52] U.S. Cl. ..... 52/79.4; 52/236.2; 52/236.3; 52/73; 52/79.9; 52/227; 52/309.9

[58] Field of Search ..... 52/79.4, 236.2, 236.3, 52/245, 236.1, 73, 79.9, 82, 79.8, 79.13, 224, 227, 309.9

[56] References Cited

U.S. PATENT DOCUMENTS

| | | | |
|---|---|---|---|
| 1,806,354 | 5/1931 | Lange | 52/82 |
| 3,068,534 | 12/1962 | Hu | 52/236.1 X |
| 3,468,083 | 9/1969 | Camoletti et al. | 52/82 X |
| 3,600,865 | 8/1971 | Vanich | 52/236.1 X |
| 3,724,142 | 4/1973 | Worthington | 52/73 |
| 3,769,766 | 11/1973 | Speidel | 52/73 |
| 3,872,635 | 3/1975 | Miram | 52/227 |
| 4,000,589 | 1/1977 | Bianchini | 52/236.1 X |
| 4,332,116 | 6/1982 | Buchanan | 52/82 |

FOREIGN PATENT DOCUMENTS

| | | | |
|---|---|---|---|
| 1517685 | 3/1968 | France | 52/79.4 |
| 1059539 | 2/1967 | United Kingdom | 52/236.1 |

*Primary Examiner*—Carl D. Friedman

[57] ABSTRACT

A generally round, radially sectioned, molded plastic modular building/home with maximum thermal efficiency and space utilization, requires no foundation.

4 Claims, 6 Drawing Figures

RADIALLY SEGMENTED PLASTIC BUILDING

This invention relates to mass production in housing. One objective being to provide at low cost a moldable, machine made structure, easily assembled in a few hours.

A further object is to provide a home with maximum space utilization.

Another object is to provide a thermally efficient building.

Another object is to provide a flexible number of rooms and or room sizes in the interior.

A still further object is to provide a structure of integral strength so that no foundation is required, with provision for vertical stacking and horizontal grouping.

Finally the objective to provide a structure which would float and be impervious to water, salt or temperature changes.

These objects have been realized in this invention. The basic approach is to have a foam structure with a tough thin outer shell. Poly-urethane foam and polycarbonate outer shell appears to be very suitable, molded rotationally in a single cavity mold. Manufactured thusly the insulative foam becomes the structure, very effective heat control.

The building is basically round, this gives the maximum interior space for the minimum exterior wall area and allows radial segmentation of the interior which is also efficient utilization of space with a central hall. The central hall is also used for the distribution of heating and cooling air, plumbing and electricity.

The structure itself is divided radially with a vacant center area used to draw the radially disposed individual sections together. Viewed from the top the pieces appear as wedges, from the side they have a "C" appearance each has a floor, exterior wall with an opening and a roof/ceiling.

The shape and the tension combine to give a very strong, rigid integral structure. One which requires no foundation and is ideal for mud, water, snow or sand.

DESCRIPTION

Figure 1:
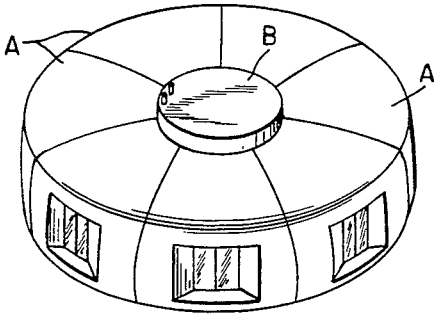
FIG. 1, is the top perspective view of the assembled building.
Figure 2:
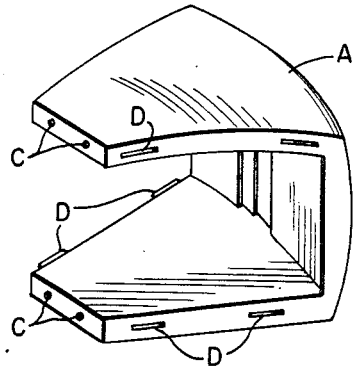
FIG. 2, is perspective view of a single wedge shaped section.
Figure 4:
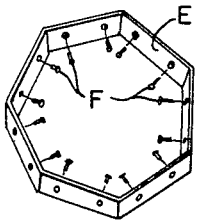
FIG. 4, is a perspective view of the central tension ring (upper and lower).

FIG. 1 shows the assembled structure in perspective. The individual wedge shaped sections A, are radially disposed, these sections do not meet in the center leaving a vacant area. This vacant center is covered by a skylight B, or roof cap at the top and by removeable floor section at the bottom. Each of the individual sections A, shown in perspective FIG. 2, are preferably of light weight, rigid, foamed plastic, having a "C" shape in cross section consisting of a floor, exterior wall with opening for a sliding glass door and a ceiling/roof. Each section is molded with a tough outside skin and a highly insulative structural foam core. Male and female slidably engaged mechanical alignment means D, are fashioned on opposite and mating locations so that each individual section A, is positively matched to the adjacent section and when the sections are drawn together the structure becomes integral. Sections A, have threaded bosses C FIG. 2 which receive bolts F FIG. 4, which are tensioned thru upper and lower tension rings E FIG. 4. Thusly as the bolts are tightened the sections squeeze together in compression. Due to the nature of this shape this compression causes the roof section to gain a lifting force and imparts a high degree of rigidity into the structure.

Figure 3:
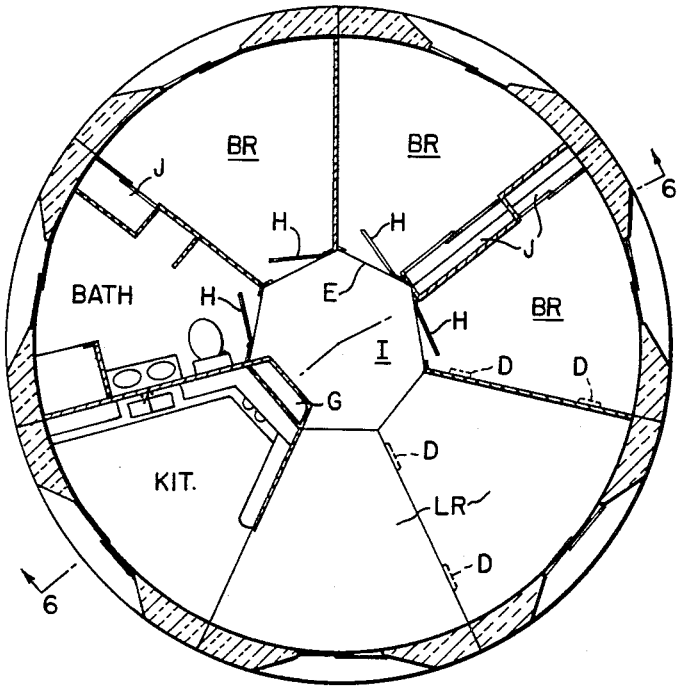
FIG. 3, is a sectional floor plan view.

Seven sections provide an excellent combination for a well balanced interior floor plan FIG. 3, consisting of two sections for the living area, three sections for bedrooms and one each for bathroom and kitchen, thusly each has light, is of good size for portability and livability. The vacant center area makes a most efficient hall, opening into the radially located rooms, when covered with a removeable floor.

Figure 6:
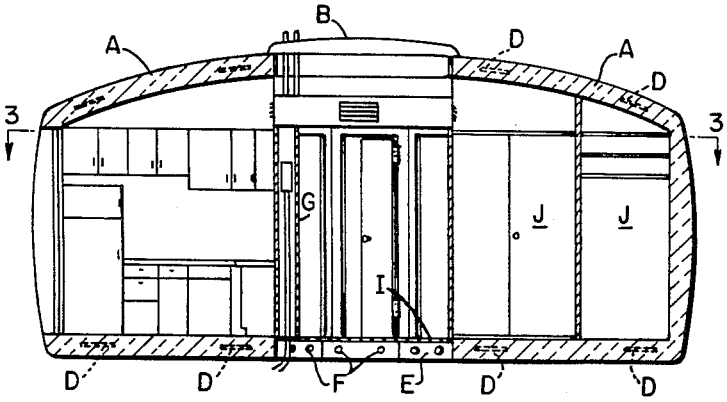
FIG. 6, is a cross sectional view thru the middle at 6—6 FIG. 3, showing kitchen and utility areas.

The vacant center section is ideal for locating, means for holding the structure down, for sewer, water, gas or electrical hookups. The overhead area is ideal for ducting for cooling air, heating air or ventilation, in a most efficient manner. FIG. 6 shows the interior of a complete structure, showing the details of the kitchen and central hall, taken as cross section 6—6 FIG. 3. Seen are interior doors H and removeable floor I, in the central area. The utility area is shown as G, the wardrobe as J.

Figure 5:
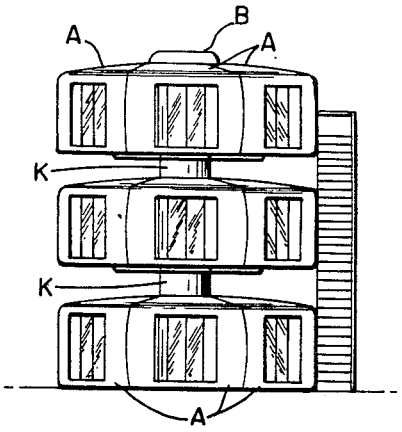
FIG. 5 is a view of multiple units vertically stacked by assembly around central support structure K at various levels.

Multiple units may be assembled as shown in FIG. 5. The supportive structure K would have tension rings E, for assembling the sections A about the structure and carry utilities to the various levels.

I claim:

1. A basically round single unit building structure wherein the major structural component is foam, the generally flat floor portion, single vertical exterior wall and upwardly inwardly sloping roof portion are internally structured of foam, comprised of radially disposed wedge shaped sections which are tensioned toward the center and compressed laterally forming a structure of such integral strength that no foundation is required.

2. The building structure according to claim 1 wherein the radially disposed sections are vertically aligned and horizontally slidable during assembly by suitably elongated male and female engagement means.

3. A basically round single unit building structure defining a single interior space, divisible internally into various floor plans, radially segmented prior to assembly, each section comprised of a generally flat floor, exterior wall and roof in a generally "C" shaped configuration when viewed from the side and wedge shaped when viewed from the top, said sections are assembled around a vacant central area containing means to draw said sections in toward the center, compressing each section laterally, forming a structure of such integral strength that no foundation is required.

4. The building structure according to claim 3 wherein the means to draw said sections in toward the center are tension rings mounted at various levels on a supportive structure.

* * * * *